United States Patent [19]

Greenwald et al.

[11] 4,133,419

[45] Jan. 9, 1979

[54] MONEY BOX SUPPORT ARRANGEMENT

[75] Inventors: Harry Greenwald, Whitestone; Salvatore Iglio, Richmond Hills, both of N.Y.

[73] Assignee: Walter Kidde & Company, Inc., Clifton, N.J.

[21] Appl. No.: 839,388

[22] Filed: Oct. 4, 1977

[51] Int. Cl.[2] ..... G07F 9/06

[52] U.S. Cl. ..... 194/1 B; 70/85; 232/15

[58] Field of Search ..... 194/1 A, 1 B, 1 F, 1 R; 70/85; 232/15, 16

[56] References Cited

U.S. PATENT DOCUMENTS

| | | | |
|---|---|---|---|
| 3,538,724 | 11/1970 | Dauenbaugh | 232/15 X |
| 3,905,460 | 9/1975 | Greenwald et al. | 194/1 B |
| 3,926,019 | 12/1975 | Mazeika | 70/85 |
| 4,037,700 | 7/1977 | Heraty | 232/15 X |

*Primary Examiner*—Joseph J. Rolla

*Attorney, Agent, or Firm*—McAulay, Fields, Fisher & Goldstein

[57] ABSTRACT

A money box support arrangement in a housing for receiving a lockable money box of the type having transversely extendable locking bolts, which support arrangement secures the money box against removal from the housing. On the housing is provided a wall having an opening into which the money box is inserted, and positioned within the housing behind said wall is a frame secured to the housing. The frame has an opening for the insertion therethrough of the money box and flanges spaced with respect to said wall to define therewith channels that receive and confine the locking bolts of the money box to secure it against further movement relative to the housing, either inwardly or outwardly, thereby preventing removal of the money box by prying.

4 Claims, 3 Drawing Figures

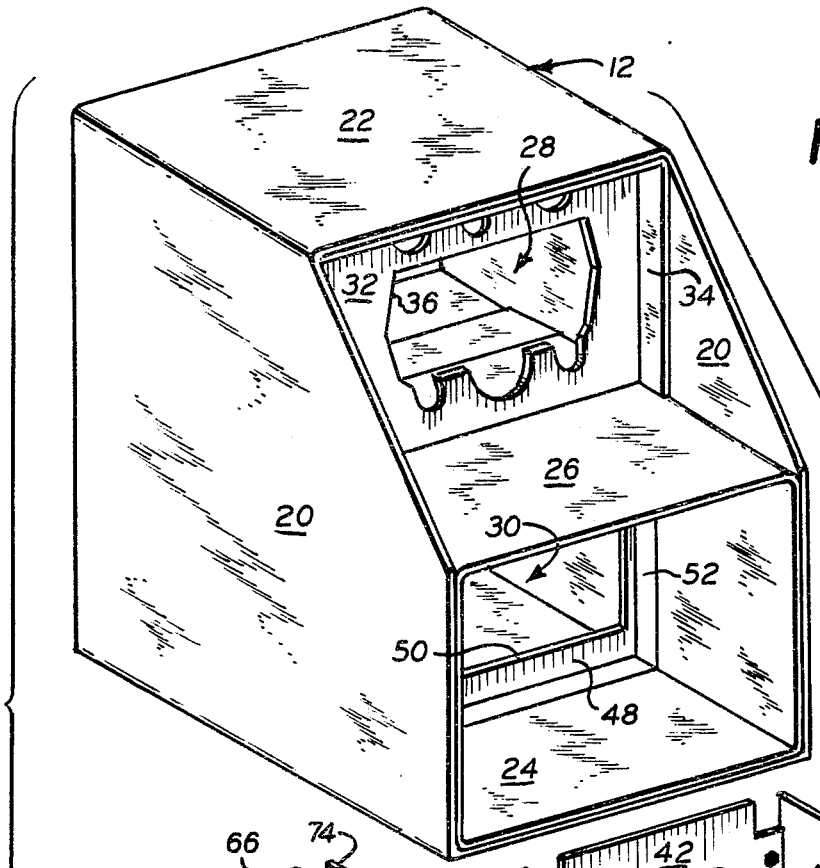
FIG. 1.
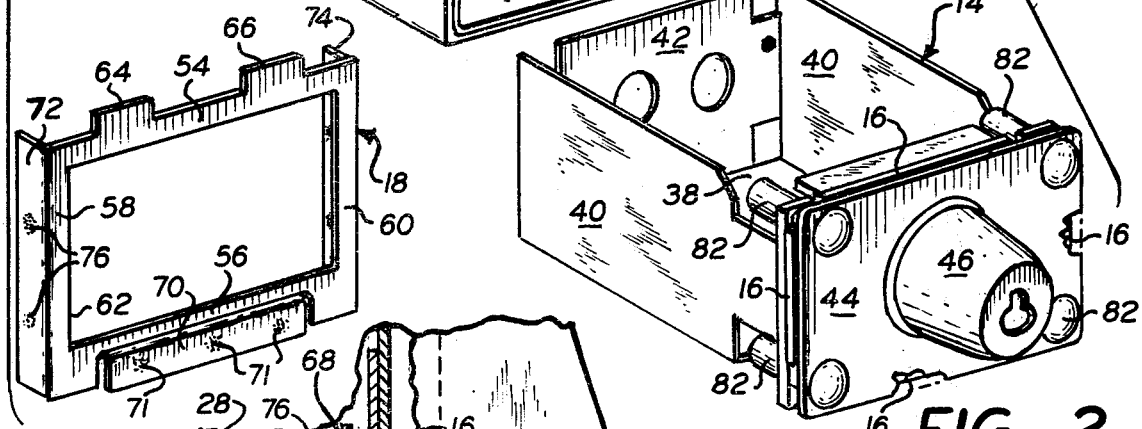
FIG. 2.
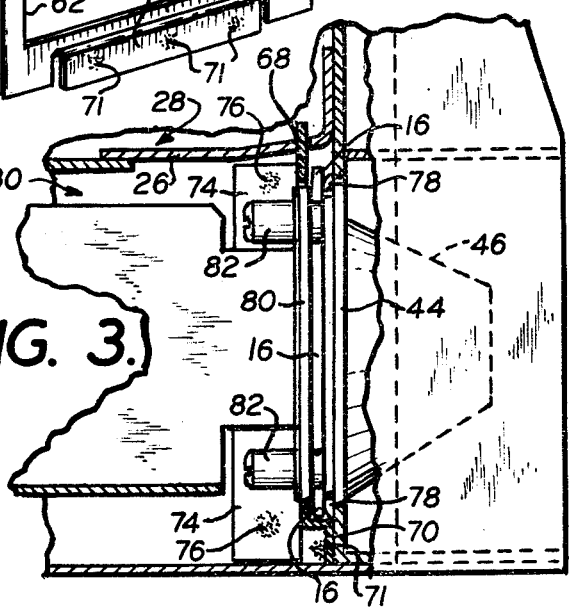
FIG. 3.
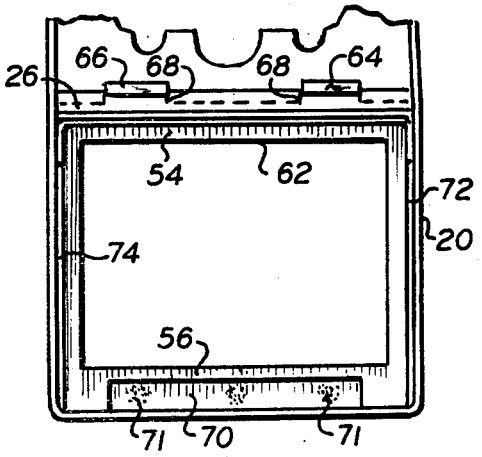

MONEY BOX SUPPORT ARRANGEMENT

BACKGROUND OF THE INVENTION

1. Field of the Invention

This invention relates generally to a coin box or money box support arrangement for a coin operated apparatus. More particularly, the invention provides a more secure money box support arrangement in a housing, that offers considerable resistance to removal of the money box by prying to force it inward or outward of the housing.

2. Description of the Prior Art

Coin operated control units have been for some time installed on commercial appliances and typically have included coin control devices and more recently control devices that accept tokens or paper money. The coin or money control is usually enclosed within a housing mounted on the appliance or vending machine, and the housing is provided with a locked drawer assembly which is intended to prevent unauthorized access to a coin box removably supported within the housing. The control typically has a slide projecting into the housing and is positioned to deliver deposited money into the money box.

The money box assembly is generally mounted on a front wall of the housing, which wall has a fitted opening through which the money box is received. A faceplate is provided on the money box and on the faceplate there is mounted a tumbler-type lock that operates transversely extendable locking bolts by which the box is locked or latched to the front wall of the housing.

Examples of prior art money boxes and support arrangements therefor are given by U.S. Pat. Nos. 3,334,501 and 3,905,460.

One of the problems of money box support arrangements is that of security. The invention provides a money box support arrangement which is highly secure against money box removal by prying, and in which a frame used in cooperation with the locking features is secured by keying and welds that are inaccessible from outside, once the money box is inserted and locked in place.

SUMMARY OF THE INVENTION

The money box support arrangement of the invention provides in effect a double frame of steel defining channels into which the money box locking bolts snugly fit after they are extended into their locking positions by turning the key in the lock. The locking bolts fit snugly not only on the inside, but completely around the frame as well. Accordingly, the money box is thus braced from all sides, and this makes prying and forcing the money box out of the housing more difficult. In addition, this makes it more difficult to force the money box inward, as might be attempted by a thief.

In using a frame giving additional support, further security is achieved by making the frame keyed into a baffle plate within the housing and spaced in relation to the housing by the required dimension to snugly envelope the money box lock bolts. At the bottom, the support frame is joggled downward and welded to the inside of the front end or wall of the housing. By thus locating the frame in the housing, a more accurate fit can be achieved for mass production, and the frame can be prefabricated and easily inserted into the housing and welded thereto. For further increased strength, the frame has two opposite side flanges that are welded to adjoining walls on the inside of the housing. These inside welds make it even more difficult to force out the money box.

Generally, the invention provides a money box support arrangement in combination with a housing for receiving a lockable money box of the type having transversely extendable locking bolts. This support arrangement comprises a wall on the housing having an opening into which the money box is inserted, a frame positioned within the housing behind said wall and secured to the housing, said frame having an opening accommodating the insertion therethrough of the money box and flanges spaced with respect to said wall to define therewith channels that receive and confine the locking bolts of the money box to secure same against further inward movement, and against further outward movement relative to the housing.

For a better understanding of the invention and its various advantages, reference should be had to the following detailed description and accompanying drawing, which together exemplify a preferred embodiment of the invention.

BRIEF DESCRIPTION OF THE DRAWING

In the drawing:

FIG. 1 is a perspective exploded view of a money box and housing combination provided with a money box support arrangement according to a preferred embodiment of the invention.

FIG. 2 is a fragmentary view, taken from inside the housing, showing a portion thereof to illustrate details of the frame installation.

FIG. 3 is a fragmentary side elevation view, partly in section, showing the money box as received in the housing and in a secured configuration in the support arrangement.

DESCRIPTION OF THE PREFERRED EMBODIMENT

In FIG. 1 there is exemplified a housing 12 and lockable money box 14, which money box 14 is equipped with transversely extendable, plate-like locking bolts 16. Housing 12 is, in accordance with a preferred embodiment of the invention, equipped with a frame 18 to provide, in combination with housing 12, a highly secure support arrangement for the money box 14.

As to certain respects, housing 12 has structural features that are known in the prior art, as does the money box 14. For example, housing 12 has opposed side walls 20 joined to a top wall 22 and to a bottom wall 24, and to a rear wall (not visible) to define a hollow box enclosure. A generally horizontal baffle plate or wall 26 divides housing 12 into an upper compartment 28 and a lower compartment 30. Upper compartment 28 is bounded at the front by a plate or wall 32 having opposed flanges 34 (only one visible) that are preferably spot-welded to respectively adjoining side walls 20. Wall 32 has an opening 36 shaped to receive a coin slide mechanism (not shown), which mechanism is of prior art construction, typically having a chute (not shown) through which money deposited is passed down into the lower compartment 30 for collection by the money box 14 that is received therein. Money box 14 itself has a bottom 38, sides 40, back panel 42 and front panel 44 joined together to define a generally rectangular open top box 14. On front panel 14 is mounted a lock 46 of prior art construction, which lock 46 operates the bolts 16.

On housing 12 there is a wall 48 that bounds the front of lower compartment 30, and has an opening 50 of generally rectangular shape into which money box 14 is inserted. Wall 48 preferably has flanges 52, one flange 52 adjoining each side and spot-welded to the respectively adjoining walls 20, 24 and 26.

Behind wall 48 and positioned within lower compartment 30 is the frame 18 which is secured to the housing 12. Frame 18 has flange portions 54, 56, 58 and 60 the inner edges of which bound and define a generally rectangular opening 62 accommodating the insertion therethrough of the money box 14. On the upper flange 54 are two spaced projecting tab parts 64 and 66 that are received through respective close-fitting openings 68 in horizontal wall 26, as better seen in FIGS. 2 and 3. The tab parts 64, 66 are thus in keying engagement with the wall 26 of the housing 12, which makes the frame 18 difficult to remove by externally applied tampering instruments. For further security, frame 18 has a bracing part 70 that is offset-bent downward and spot welded at 71 to the inside face of wall 48. Integrally connected to the side flanges 58, 60 of frame 18 are additional flanges 72, 74 respectively that extend at generally right angles to corresponding flanges 58, 60. These flanges 72, 74 are spot welded at 76 to the inside faces of corresponding side walls 20 of housing 12.

On wall 48, at the edges thereof defining the opening 50, are provided recessed lips 78 that engage the back of money box front panel 44 to limit the insertion of money box 14, such that the front of panel 44 is approximately flush with the front of wall 48, thereby making it more difficult to get a pry tool between panel 44 and the wall 48.

Locking bolts 16 are located between front panel 44 and a back cover plate 80 secured to panel 44 by spacer bolts 82. As better appreciated from FIG. 3, when lock 46 is set into an unlocked state, the bolts 16 are retracted so as to lie within the boundary edges of panel 44 and cover plate 80, thereby enabling the money box 14 to be withdrawn. When lock 46 is set to the locked state, the bolts 16 are extended outwardly beyond the edges of panel 44 and plate 80 into the locking configuration shown by FIG. 3.

The flanges 54, 56, 58, 60 of frame 18 are so spaced with respect to wall 48, so as to define with said wall 48 channels that receive and confine the locking bolts 16 of the money box 14 to secure same against further inward movement, and against further outward movement relative to the housing 12. In this regard, frame 18 blocks further inward movement of box 14 when bolts 16 are extended, whereas wall 48 blocks further outward movement of box 14 in such case.

While a preferred embodiment of the invention has been shown and described in detail, it will be readily understood and appreciated that numerous omissions, changes and additions may be made without departing from the spirit and sope of the present invention.

What is claimed is:

1. In combination with a housing for receiving a lockable money box of the type having transversely extendable locking bolts, a money box support arrangement which comprises a wall on said housing having an opening into which the money box is inserted, a frame positioned within said housing behind said wall and secured to the housing, said frame having an opening accommodating the insertion therethrough of the money box and flanges spaced with respect to said wall to define therewith channels that receive and confine the locking bolts of the money box to secure same against further inward movement, and against further outward movement relative to the housing.

2. The combination according to claim 1 wherein said frame has at least one projecting part in keying engagement with a part of said housing to secure the frame in fixed relation thereto.

3. The combination according to claim 1 wherein said frame has a part welded to said wall on the housing.

4. The combination according to claim 1 wherein said frame has at least one projecting tab extending through an opening in a plate of the housing in keying engagement with said plate to secure the upper portion of the frame in fixed relation to the housing, and said frame having additional flanges extending therefrom and welded to the housing.

* * * * *